US008499553B2

(12) United States Patent
Cai

(10) Patent No.: US 8,499,553 B2
(45) Date of Patent: Aug. 6, 2013

(54) PISTON TYPE PNEUMATIC ENGINE

(76) Inventor: Daode Cai, Guangzhou (CN)

( * ) Notice: Subject to any disclaimer, the term of this patent is extended or adjusted under 35 U.S.C. 154(b) by 0 days.

(21) Appl. No.: 13/337,282

(22) Filed: Dec. 26, 2011

(65) Prior Publication Data

US 2012/0090456 A1 Apr. 19, 2012

Related U.S. Application Data

(63) Continuation of application No. PCT/CN2010/070485, filed on Feb. 3, 2010.

(30) Foreign Application Priority Data

Jun. 30, 2009 (CN) ..... 2009 1 0040696

(51) Int. Cl.
*F01B 29/10* (2006.01)

(52) U.S. Cl.
USPC ..... 60/370; 91/273; 91/441

(58) Field of Classification Search
USPC .... 91/45, 271, 272, 273, 350, 441; 123/44 E, 123/54.3, 90.16, 90.41, 47 AB, 190.17; 60/370
See application file for complete search history.

(56) References Cited

U.S. PATENT DOCUMENTS 2,193,576 A * 3/1940 Torjussen ..... 123/61 R
2009/0044778 A1* 2/2009 Scuderi et al. ..... 123/188.2

FOREIGN PATENT DOCUMENTS

CN 1295940 A * 5/2001
WO WO 0166917 A1 * 9/2001

* cited by examiner

*Primary Examiner* — Edward Look
*Assistant Examiner* — Logan Kraft
(74) *Attorney, Agent, or Firm* — Matthias Scholl P.C.; Matthias Scholl

(57) ABSTRACT

A piston type pneumatic engine, including a cylinder block, a piston, a cylinder, a crankshaft, a connecting rod, a camshaft, and a device for controlling the opening or closing of a gas valve. A cylinder cover arranged on the cylinder block is provided with an inwardly-opened type compressed-gas intake valve and an exhaust valve. An intake cam and an exhaust cam are arranged on the camshaft. The opening or closing of the intake and the exhaust valves is controlled by a rocker arm which is driven by the camshaft. The camshaft is driven by the rotated crankshaft via a timing chain or belt.

12 Claims, 16 Drawing Sheets

PISTON TYPE PNEUMATIC ENGINE

CROSS-REFERENCE TO RELATED APPLICATIONS

This application is a continuation of International Patent Application No. PCT/CN2010/070485 with an international filing date of Feb. 3, 2010, designating the United States, now pending, and further claims priority benefits to Chinese Patent Application No. 200910040696.X filed Jun. 30, 2009. The contents of all of the aforementioned applications, including any intervening amendments thereto, are incorporated herein by reference.

BACKGROUND OF THE INVENTION

1. Field of the Invention

The invention relates to an engine, and more particularly to a piston type pneumatic engine adopting compressed air as power source.

2. Description of the Related Art

Gasoline and diesel fuel are adopted in most of engines of automobiles as power. However, not only the exhaust of waste gas of automobiles taking the gasoline and the diesel fuel as power influences global climate, but also the development of the automobile industry is restricted by energy which becomes gradually scarce. Therefore, countries through out the world are looking for new energy which can substitute the gasoline and the diesel, as well as researching and developing the engines using new energy.

As for a common piston type engine in which the gasoline and the diesel are taken as fuel, the fuel and the air are mixed and burned in a cylinder through igniting method or compression-ignition method, and high-temperature high-pressure expanded fuel gas is produced and expanded to drive a piston to do work and to output mechanical power via a crank mechanism of a connecting rod. The cylinders of these two kinds of the engines are generally provided with an intake port and an exhaust port. The intake port is used for spraying gasoline and air which are mixed together, and the exhaust port is used for exhausting burned waste gas.

The piston type pneumatic engine is the engine taking compressed gas as power, with the advantages of cleanness, convenient air inflation and, no pollution exhaust. It has essential differences with an internal combustion engine used currently and engines taking charged batteries as power; therefore the development of the piston type pneumatic engine has become one research direction in the automobile industry. However, up to now, a series of problems of low use ratio and insufficient intensity of thrust, which are occurred when the piston of the cylinder is driven to do work by the compressed air and compressed energy of high-pressure gas is converted into mechanical energy, are not solved really.

There is a piston type pneumatic engine in the art in which compressed air is adopted as power source. The engine includes a piston cylinder. Two gas valves are arranged on a cylinder cover, wherein one gas valve is taken as an intake valve of compressed air of the power source, and the other is taken as an exhaust valve of low-pressure air after working is completed. The opening or closing time of the intake and exhaust valves is controlled by the intake and exhaust cams of the camshaft of the engine. High-pressure gas is controlled to enter, and the low-pressure gas is controlled to be exhausted. The high-pressure gas enters the cylinder through the intake valve to promote the reciprocating motion of the piston and then to facilitate the crankshaft to be rotated and generate power output. In the course of a plurality of designs and experiments, a common opening method of an internal combustion engine in which the intake valve is opened toward the inner part of the cylinder is abandoned, and an opening structure in which the intake valve is opened toward the inner part of an intake channel is adopted according to the characteristic that the compressed air has high pressure. The bigger the gas pressure in the intake channel is, the more tightly the intake port is pressed by the intake valve; therefore, the problem that the impact and leakage of high-pressure gas from the intake channel is caused by the structure that the common intake port of the internal combustion engine is opened toward the inner part of the cylinder is solved. During the experiment, it is discovered that the piston cylinder of the proposal only has working stroke and exhaust stroke. After the compressed gas enters the cylinder, the temperature in the cylinder is lowered and the use ratio of the compressed gas in the cylinder is not high. As for these problems, an improvement has been made: the suction stroke is added, and one exhaust valve is adopted to realize exhaust and suction functions at the same time. However, during the experiments, it showed that the use ratio of the compressed air was not high, which is because the intake valve is equal to a throttle valve when the high-pressure gas enters the cylinder. As the one exhaust valve not only exhausts gas but also sucks gas, the exhausted low-pressure cold compressed gas is sucked and compressed again, thus facilitating the temperature in the cylinder to become lower and lower, causing the engine to be frosted finally, causing the piston to be blocked, and lowering the use ratio of the working energy of the compressed gas.

Meanwhile, as high-pressure gas is adopted as power source, during the upward and downward long-time opening course, wear and gas leakage appear. The pressure intensity of the high-pressure gas in the intake channel and the cylinder are lowered by the gas leakage, which is the technical difficulty of the pneumatic engine. To increase sealing effect, an intake valve with better sealing effects has been developed.

With experiments, it is discovered that: being different from combustion working of the internal combustion engine, the expansion force produced when the fuel in the cylinder of the internal combustion engine is burned is relatively large, and the bore-stroke ratio of the cylinder and the piston is relatively large. However, as for the engine taking the compressed air as power source, if the bore-stroke ratio of the cylinder and the piston is too large, the resistance occurred when the piston is compressed is relatively large and power output is greatly decreased. Therefore, the proper bore-stroke ratio of the cylinder and the piston, which is researched and adopted, is also one technical difficulty of the invention.

SUMMARY OF THE INVENTION

In view of the above-described problems, it is one objective of the invention to provide a piston type pneumatic engine which effectively increases the use ratio of the energy of high-pressure gas in the pneumatic engine, increases the temperature of a cylinder when working is done, prevents the cylinder of the engine from being frosted, prevents the piston from being blocked, increases sealing effect of an intake valve, lowers the resistance of the compressed cylinder, and increases power output.

To achieve the above objective, in accordance with one embodiment of the invention, there is provided a piston type pneumatic engine, comprising a cylinder block, a piston, a cylinder, a crankshaft, a connecting rod, a camshaft, and a device for controlling the opening or closing of a gas valve, wherein a cylinder cover is arranged on the cylinder block; an inwardly-opened type compressed-gas intake valve and an exhaust valve are arranged on the cylinder cover; an intake cam and an exhaust cam are arranged on the camshaft; the opening or closing of the intake and the exhaust valves is controlled by a rocker arm which is driven by the camshaft; the camshaft is driven by the rotated crankshaft via a timing chain or belt, and then high-pressure gas is controlled to enter the cylinder to promote the reciprocating motion of the piston and to exhaust low-pressure gas when working is completed; the crankshaft is driven and rotated by the piston via the connecting rod to output power; a suction channel and a suction valve are also arranged on the cylinder cover; a suction cam is also arranged on the camshaft; the opening or closing of the suction valve is controlled by the rocker arm so as to control the timing for the cylinder to suck the air outside and be closed; and the bore-stroke ratio of the cylinder and the piston is 1:2-15, preferably 1:10.

As the invention is a piston type pneumatic engine taking compressed air as power source, and the bore-stroke ratio of the cylinder and the piston is 1:2-15, relatively large compressed ratio can be obtained and resistance produced when the piston is lowered can be decreased. In additions, as the suction channel and the suction valve are also provided on the cylinder cover, air is sucked through the suction channel and the suction valve when the piston is moved downwards. After compressed stroke is completed, the sucked air is compressed and produces high temperature. When an intake valve is opened, the compressed air under low temperature rushes into the cylinder and is heated by the high-temperature air and sucks heat. The compressed air sucks heat, is expanded and produces larger thrust, thereby increasing the use ratio of the energy of the compressed air.

In a class of this embodiment, a groove is arranged on the cylinder cover corresponding to a cylinder port. An intake port, an exhaust port, and a suction port are arranged on the inner wall of the groove. An intake channel, an exhaust channel, and a suction channel are respectively arranged on each the corresponding port. The intake channel is externally connected with a compressed air source. The suction and the exhaust channels are externally connected with atmosphere. The intake, the exhaust, and the suction valves are correspondingly arranged at the intake, the exhaust and the suction ports on the inner wall of the groove. The suction and the exhaust valves are opened toward the inner part of the groove, and the intake valve is opened toward the inner part of the intake channel.

In a class of this embodiment, one end of the rocker arm of the intake, the exhaust, and the suction valves is hinged; the middle of the rocker arm is connected with an intake valve rod, an exhaust valve rod, and a suction valve rod; and the other end of the rocker arm corresponds to the intake, the exhaust, and the suction cams of the camshaft.

In a class of this embodiment, an intake duration angle, an exhaust duration angle, and a suction duration angle of the intake, the exhaust, and the suction cams are 15-60 degrees, 15-165 degrees, and 70-90 degrees, respectively. The start-point intervals between the intake cam and the exhaust and the suction cams are: 15-90 degrees and 180-200 degrees, respectively.

In a class of this embodiment, the structure of the intake port which is arranged on the inner wall of the groove of a cylinder cover and is opened toward the inner part of the intake channel is: a fixed and vertical guide rod is arranged at the back of a gas valve corresponding to the shape of the intake port. After the ends of the guide rod pass through a guild-rod slide path, they are connected with an intake rocker arm of a device for controlling the opening or closing of the intake and exhaust valves of the camshaft. A compressed return spring is sleeved on the guide rod, thus facilitating the intake valve to close the intake port from the inner part of the intake channel.

In a class of this embodiment, the structures of the exhaust and the suction valves are: the fixed and vertical guide rod is arranged at the back of the gas valve corresponding to the shapes of the exhaust and the suction ports. After the ends of the guide rod pass through the guild-rod slide path, they correspond to the exhaust rocker arm and the suction rocker arm of the device for controlling the opening or closing of the exhaust and the suction valves of the camshaft. The compressed return spring is sleeved on the guide rod, thus facilitating the exhaust and the suction valves to close the exhaust and the suction ports from the outside of the groove of the cylinder cover.

In a class of this embodiment, the intake, the exhaust, and the suction valves are wrapped with a sealing rubber sleeve. The guide rod is arranged in the guide-rod slide path through the valve guide pipe. The guide rod at the lower part of the valve guide pipe is externally sleeved with a valve-rod sealing ring. A retractable folded structure or an expansion structure is arranged at the middle of the valve-rod sealing ring The invention relates to four stroke engines, of which the working principles and the strokes are as follows:

Suction stroke: the suction valve is opened; the intake and the exhaust valves are closed; the piston is moved downwards and reaches the lower dead center, and air enters into the cylinder via the suction valve;

Compressed stroke: the suction, the intake and the exhaust valves are closed; the piston is moved and reaches the upon dead center, and air is compressed by the piston to facilitate the temperature of the gas to be increased;

Working stroke: the suction and the exhaust valves are closed; the intake valve is opened; the compressed gas enters the cylinder through the intake valve; the compressed gas is expanded immediately when it meets the high-temperature and high-pressure gas in the cylinder, and the piston is pushed, is moved downwards and drives the crankshaft to do work through a connecting rod.

Exhaust stroke: the suction and intake valves are closed; the exhaust valve is opened; the piston is moved upwards and reaches the upper dead center; the gas in the cylinder is exhausted out of the exhaust valve, and one working cycle is completed. Then the suction stroke is carried out and the next cycle starts.

Advantages of the invention are summarized as follows. As the suction channel and the intake valve are designed, and the suction and the compressed strokes are added based on the intake and the exhaust valves, the sucked air produces high temperature in the compressed stroke, thus facilitating the cylinder block to be heated. Heat is fully absorbed by the compressed gas and then energy is released fully when the gas enters the cylinder from the intake valve, thereby increasing the use ratio of enthalpy of the compressed gas, obtaining relatively large power output, preventing the temperature of the cylinder from being lowered, preventing the cylinder from being frosted, preventing the piston from being blocked, and creating conditions to guarantee the smooth reciprocating motion of the piston at the same time. A sealing rubber sleeve and a sealing ring are arranged on the intake valve and an intake valve rod, thus facilitating the high-pressure gas in a gas chamber to be difficulty leaked into the cylinder and not to be leaked outwards. On the one hand, normal work of the piston is guaranteed, on the other hand, the compressed gas is guaranteed to have enough pressure, thereby thoroughly solving the problem that high-pressure gas in the pneumatic engine is often leaked, and effectively improving the sealing effects of the intake valve. The resistance in the compressed stroke of the cylinder is lowered by relatively small bore-stroke ratio of the cylinder and the piston, which is greatly different from the internal combustion engine, meanwhile, power output is greatly increased.

Figure 1:
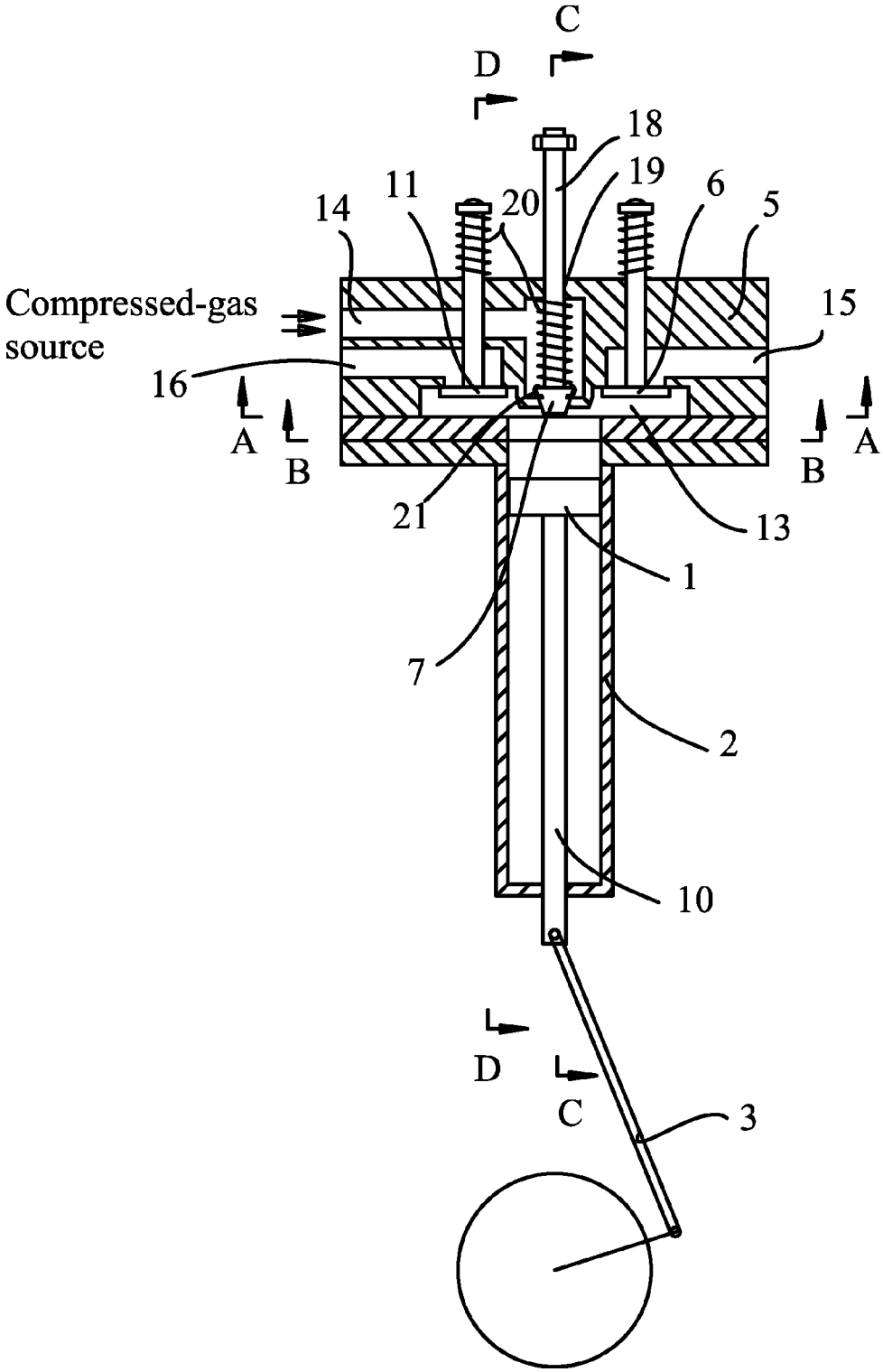
FIG. 1 is a sectional-view of a piston type pneumatic engine according to one embodiment of the invention.
Figure 2:
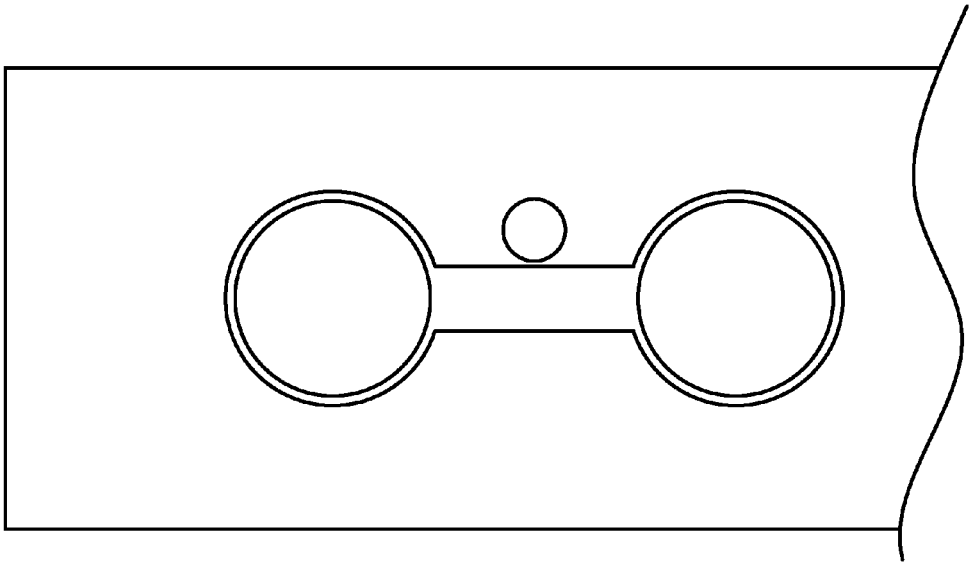
FIG. 2 is a sectional-view of a piston type pneumatic engine along the A-A line of the FIG. 1.

In the drawings, the following reference numbers are used: 1. Piston; 2. Cylinder; 3. Crankshaft Connecting Rod; 4. Camshaft; 5. Cylinder Cover; 6. Exhaust Valve; 7. Intake Valve; 8. Intake Cam; 9. Exhaust Cam; 10. Piston Rod; 11. Suction Valve; 12. Suction Cam; 13. Groove; 14. Intake Channel; 15. Exhaust Channel; 16. Suction Channel; 17. Rocker Arm; 18. Valve Guide Rod; 19. Guide-Rod Slide Path; 20. Compressed Return Spring; 21. Sealing Rubber Sleeve; 22. Timing Chain; 23. Cross Pin; 24. Lengthwise Slide Grooves; 25. Flywheel; 26. Crankshaft; 27. Valve Guide Pipe; 28. Valve-Rod Sealing Ring; 29. Folded Structure; 30. Expansion Structure.

DETAILED DESCRIPTION OF THE EMBODIMENTS

For further illustrating the invention, experiments detailing a piston type pneumatic engine adopting compressed air as power source are described below. It should be noted that the following examples are intended to describe and not to limit the invention.

Figure 3:
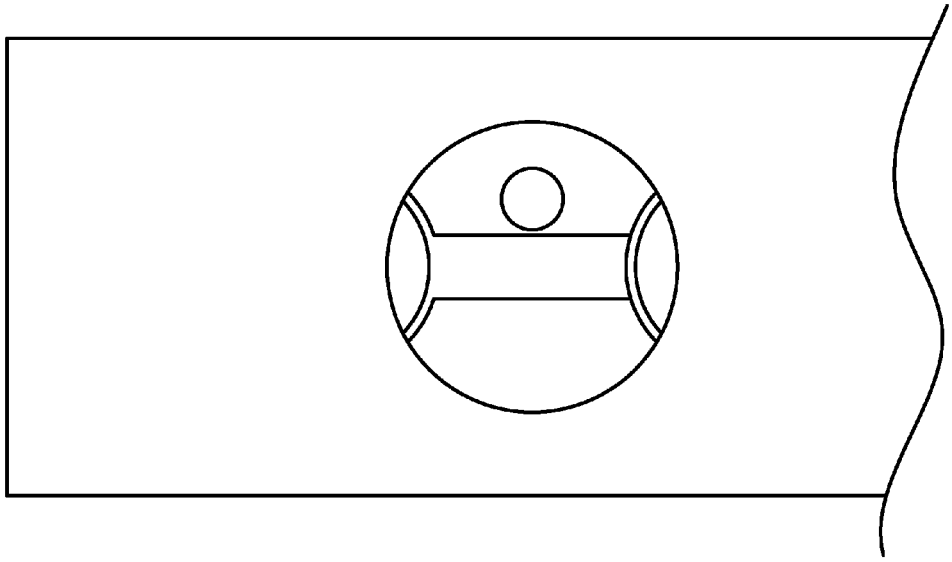
FIG. 3 is a sectional-view of a piston type pneumatic engine along the B-B line of the FIG. 1.
Figure 4:
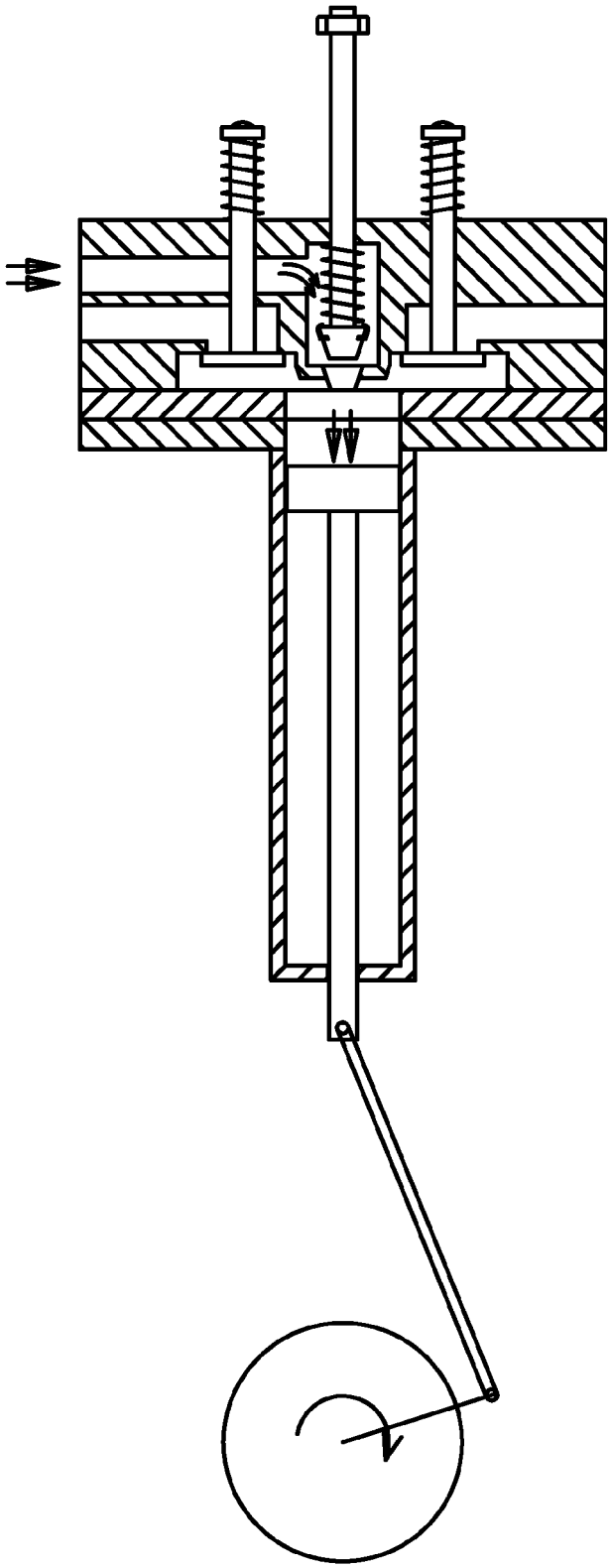
FIG. 4 is a state schematic diagram of each gas valve of working stroke of compressed gas entering a cylinder according to one embodiment of FIG. 1.
Figure 5:
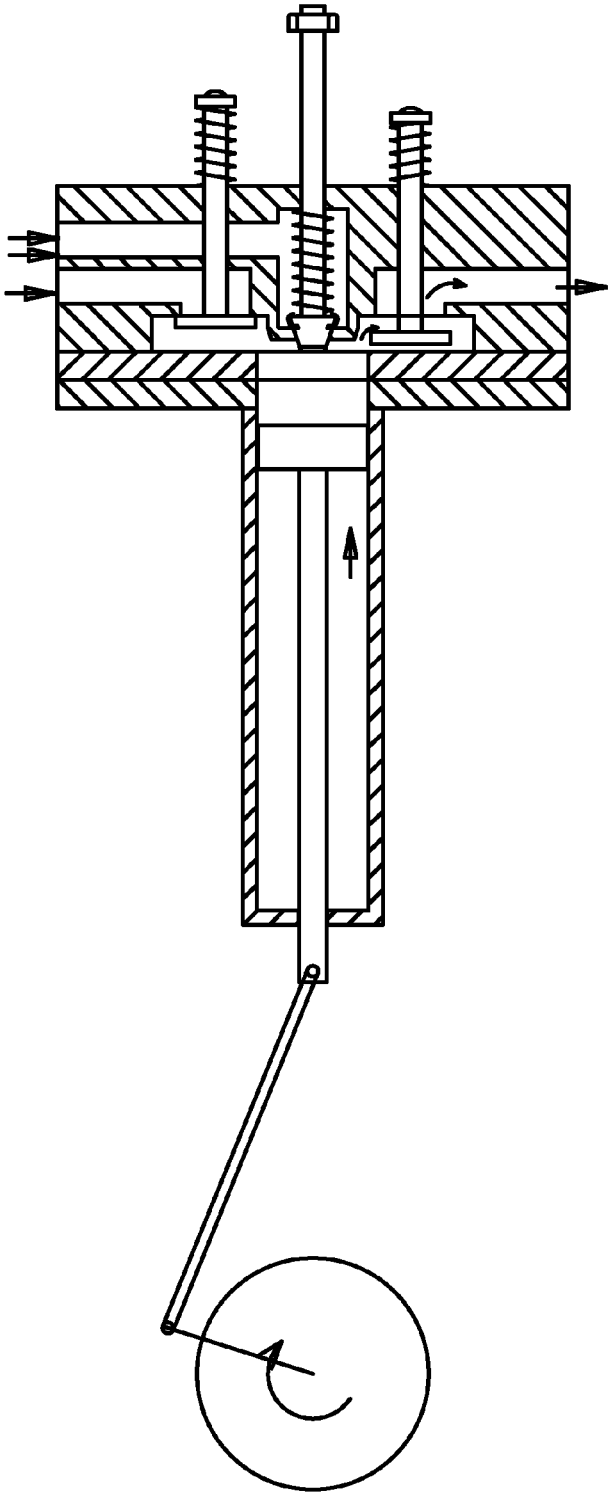
FIG. 5 is a state schematic diagram of each gas valve of an exhaust stroke according to one embodiment of FIG. 1.
Figure 6:
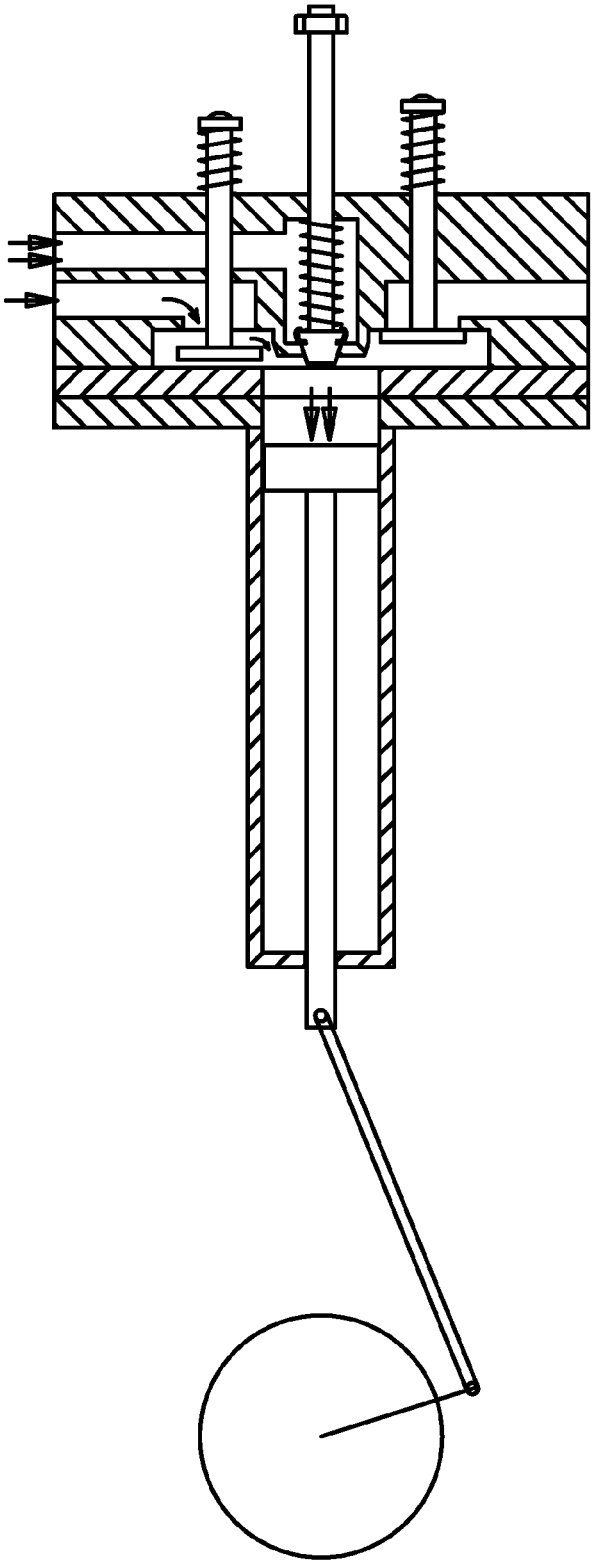
FIG. 6 is a state schematic diagram of each gas valve of a suction stroke according to one embodiment of FIG. 1.
Figure 7:
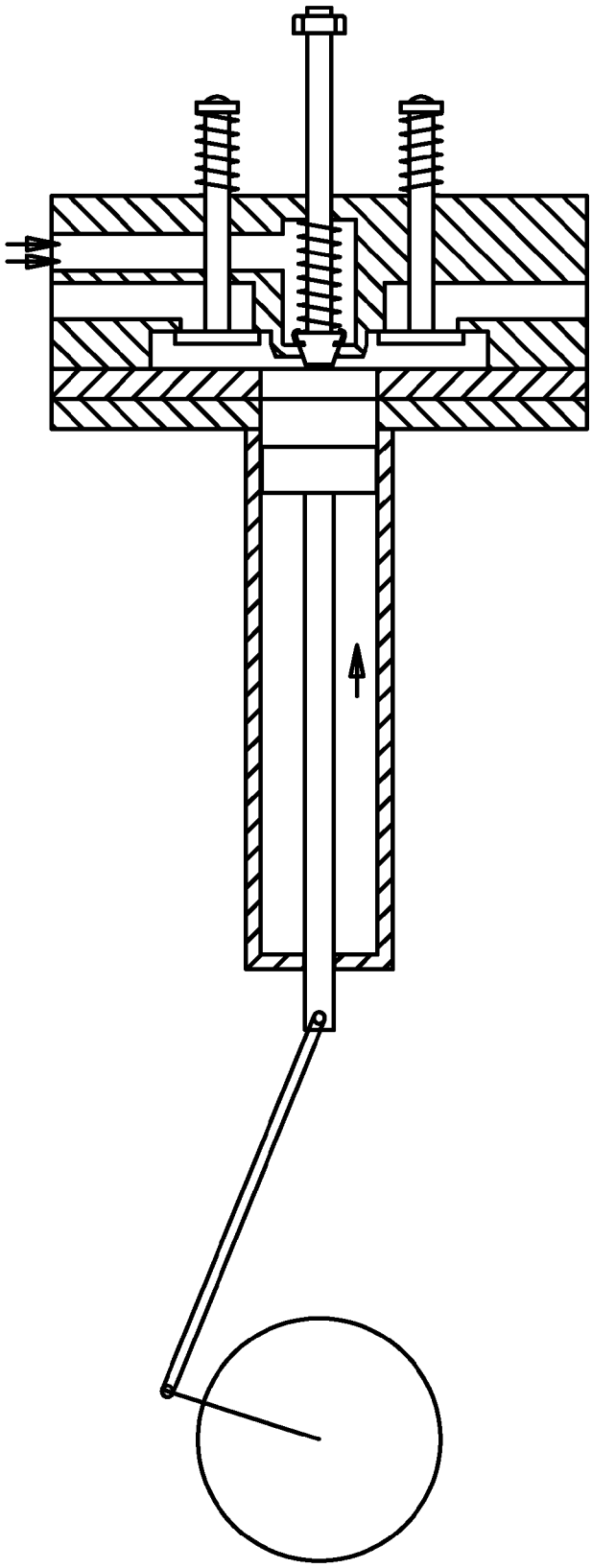
FIG. 7 is a state schematic diagram of each gas valve of a compressed stroke according to one embodiment of FIG. 1.
Figure 8:
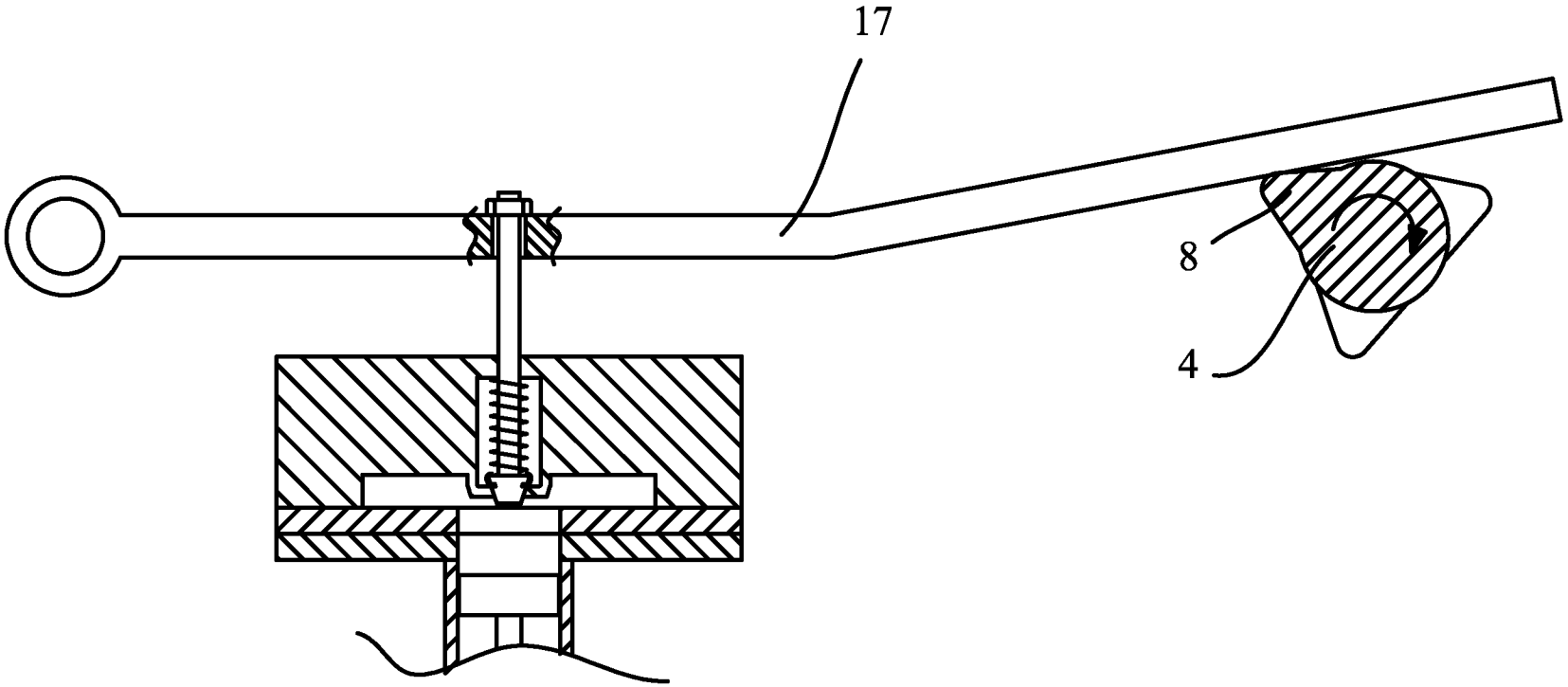
FIG. 8 is a sectional-view of a piston type pneumatic engine along the C-C line of the FIG. 1.
Figure 9:
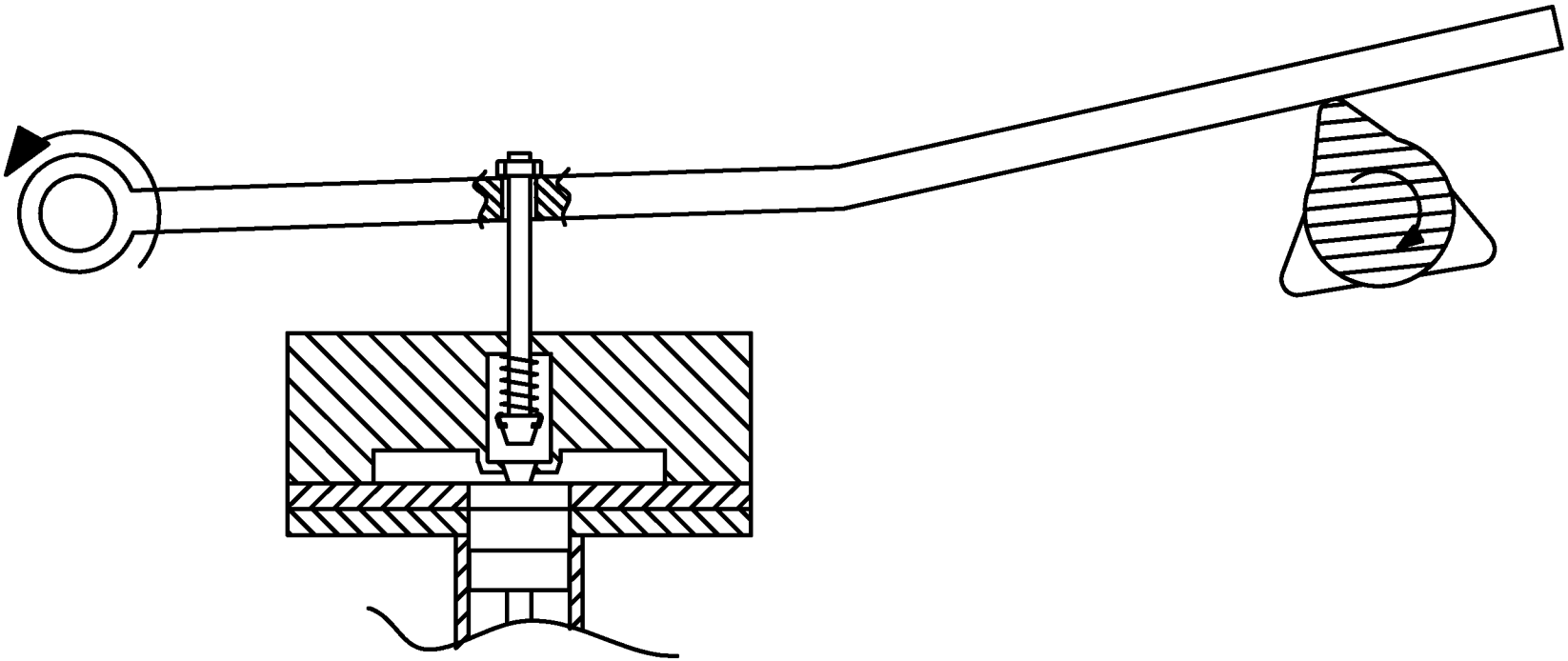
FIG. 9 is a state schematic diagram of an intake valve of working stroke of FIG. 8.
Figure 10:
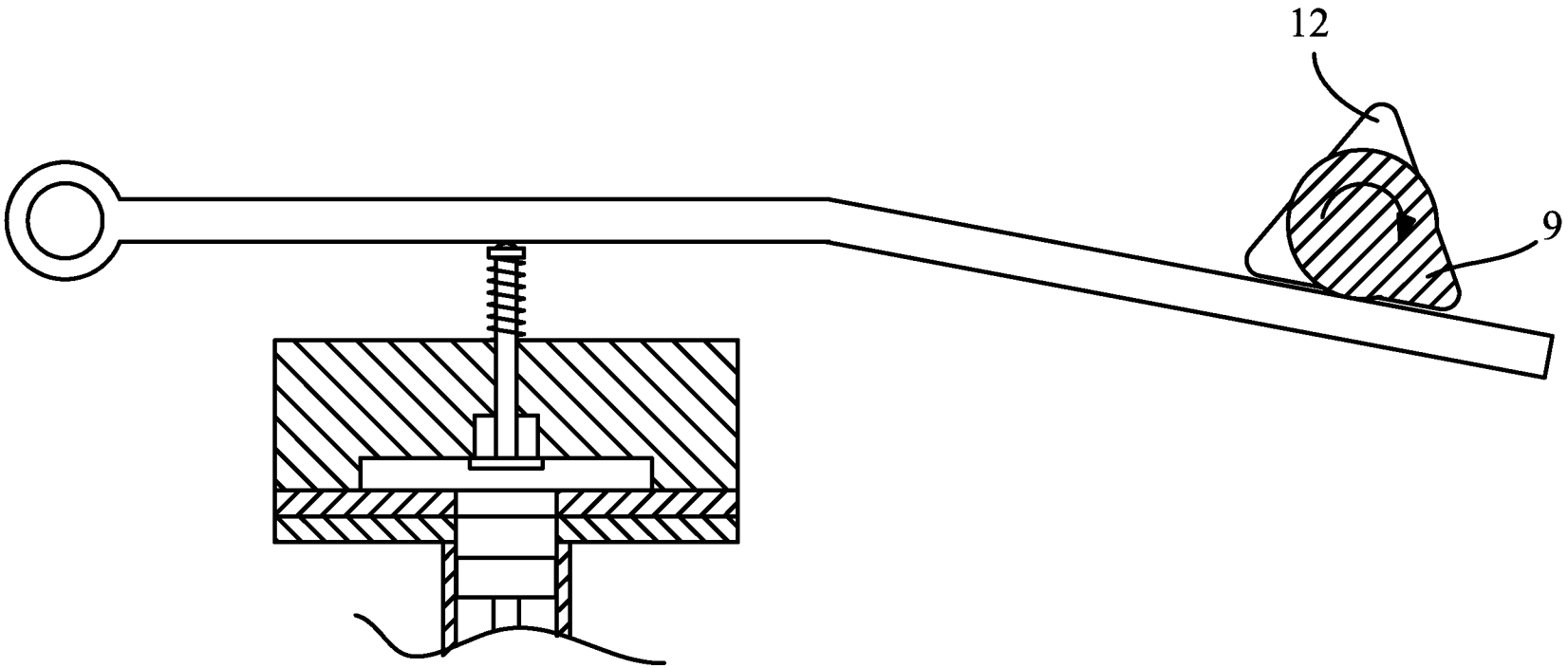
FIG. 10 is a sectional-view of a piston type pneumatic engine along the D-D line of the FIG. 1.
Figure 11:
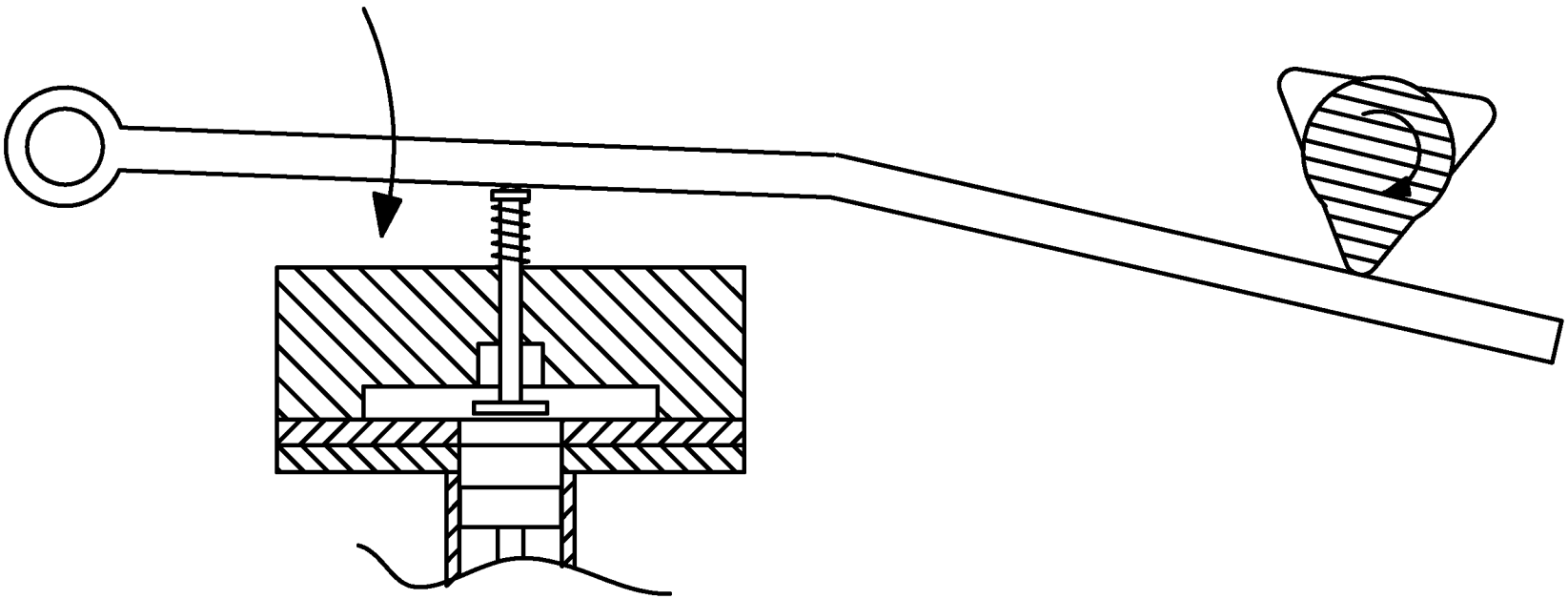
FIG. 11 is a state schematic diagram of an exhaust valve or a suction valve of an exhaust stroke or a suction stroke according to FIG. 10.

As shown in FIG. 1, a piston type pneumatic engine of one embodiment of the invention comprises a piston 1, a cylinder 2, a crankshaft, a connecting rod 3, and a device for controlling the opening or closing of an intake valve and an exhaust valve of a camshaft. A cylinder cover 5 is arranged on the cylinder 2. A groove 13 is provided on the cylinder cover 5 corresponding to a cylinder port; an intake port, an exhaust port, and a suction port are provided on the inner wall of the groove 13. An intake channel 14, an exhaust channel 15, and a suction channel 16 are respectively provided at each corresponding port. The intake channel 14 is externally connected with a compressed-gas source. The suction and the exhaust channels 16, 15 are externally connected with atmosphere. An intake valve 7, an exhaust valve 6, and a suction valve 11 of internally-opened compressed gas are correspondingly provided at the intake, the exhaust and the suction ports on the inner wall of the groove. The suction and the exhaust valves 11, 6 are opened toward the inner part of the groove 13 (See FIGS. 5 and 6), and the intake valve 7 is opened toward the inner part of the intake channel 14 (See FIG. 3).

As shown in FIGS. 8-11, the opening or closing of the intake, the exhaust and the suction valves 7, 6, and 11 is controlled by the intake, the exhaust, and the suction cams 8, 9, and 12 provided on the camshaft 4, which further control the entering of the high-pressure gas, the exhaust of the low-pressure gas when working is completed, and the compressing of sucked air. The high-pressure gas enters the cylinder 2 to promote the reciprocating motion of the piston 1. As shown in FIG. 1, the crankshaft is driven and rotated by the piston 1 via the connecting rod 3 to output power. As the bore-stroke ratio of the cylinder and the piston is 1: 2-15, most preferably 1: 10, the connecting rod 3 of a connecting-rod device of the crankshaft is hinged on the ends of a piston rod 10, which are fixed on the piston 1 and extend out of the cylinder.

Figure 12:
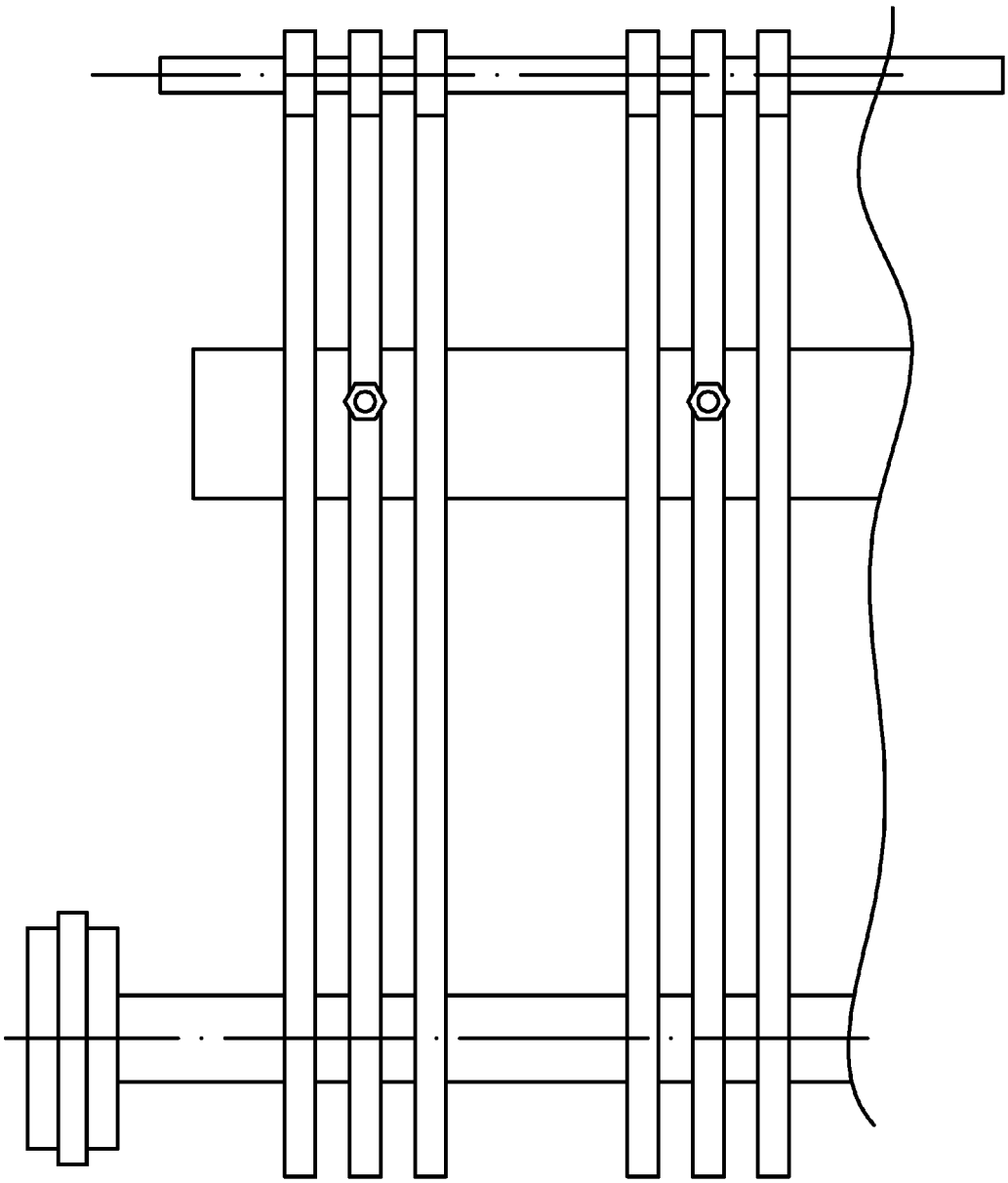
FIG. 12 is a sectional-view of a device for controlling the opening or closing of an intake valve and an exhaust valve of a camshaft according to one embodiment of the invention.

As shown in FIG. 12, one end of the rocker arm 17 of the intake, the exhaust and the suction valves 7, 6, and 11 is hinged with the fixed axle. The middle of the rocker arm is connected with the guide rods 18 of the intake, the exhaust, and the suction valves 7, 6, and 11, and the other end of the rocker arm corresponds to the intake, the exhaust and the suction cams 8, 9, and 12 of the camshaft 4. An intake duration angle, an exhaust duration angle and a suction duration angle of the intake, the exhaust, and the suction cams 8, 9, and 12 are respectively 15-60 degrees, 15-165 degrees, and 70-90 degrees. The start-point intervals between the intake cam 8 and the exhaust cam 9 and the suction cam 12 are: 15-90 degrees and 180-200 degrees, respectively.

The camshaft 4 is driven by the rotated crankshaft 26 via the timing chain 22. The opening or closing of the intake, the exhaust, and the suction valves (7, 6, and 11) is controlled by the intake, the exhaust, and the suction cams 8, 9, and 12 on the camshaft 4 via the rocker arm 17, which further control the high-pressure gas to enter the cylinder 2 to promote the reciprocating motion of the piston 1, compress the sucked air and exhaust low-pressure gas. The crankshaft is driven and rotated by the piston 1 via the connecting rod 3 to output power (See FIG. 13).

The structure of the intake valve 7 which is arranged on the inner wall of the groove 13 of a cylinder cover 5 and is opened toward the inner part of the intake channel 14 is: a fixed and vertical guide rod 18 is arranged at the back of a gas valve corresponding to the shape of the intake port. After the ends of the guide rod 18 pass through a guild-rod slide path 19 on the wall of the cylinder, they are connected with an intake rocker arm 17 of a device for controlling the opening or closing of the intake valve of the camshaft. A compressed return spring 20 is also sleeved on the guide rod 18, thus facilitating the intake port to be closed from the inner part of the intake channel 14 by the intake valve 7.

The structures of the exhaust and the suction valves 6, 11 are similar to the intake valve 7: the fixed and vertical guide rod is arranged at the back of the gas valve corresponding to the shapes of the exhaust and the suction ports. After the ends of the guide rod pass through the guild-rod slide path on the wall of the cylinder, they correspond to the exhaust rocker arm and the suction rocker arm of the device for controlling the opening or closing of the suction and the exhaust valves of the camshaft. The compressed return spring 20 is sleeved on the guide rod, thus facilitating the exhaust and the suction ports 6, 11 to be closed from the outside of the groove 13 of the cylinder cover 5 by the exhaust and the suction valves 6, 11.

Figure 14:
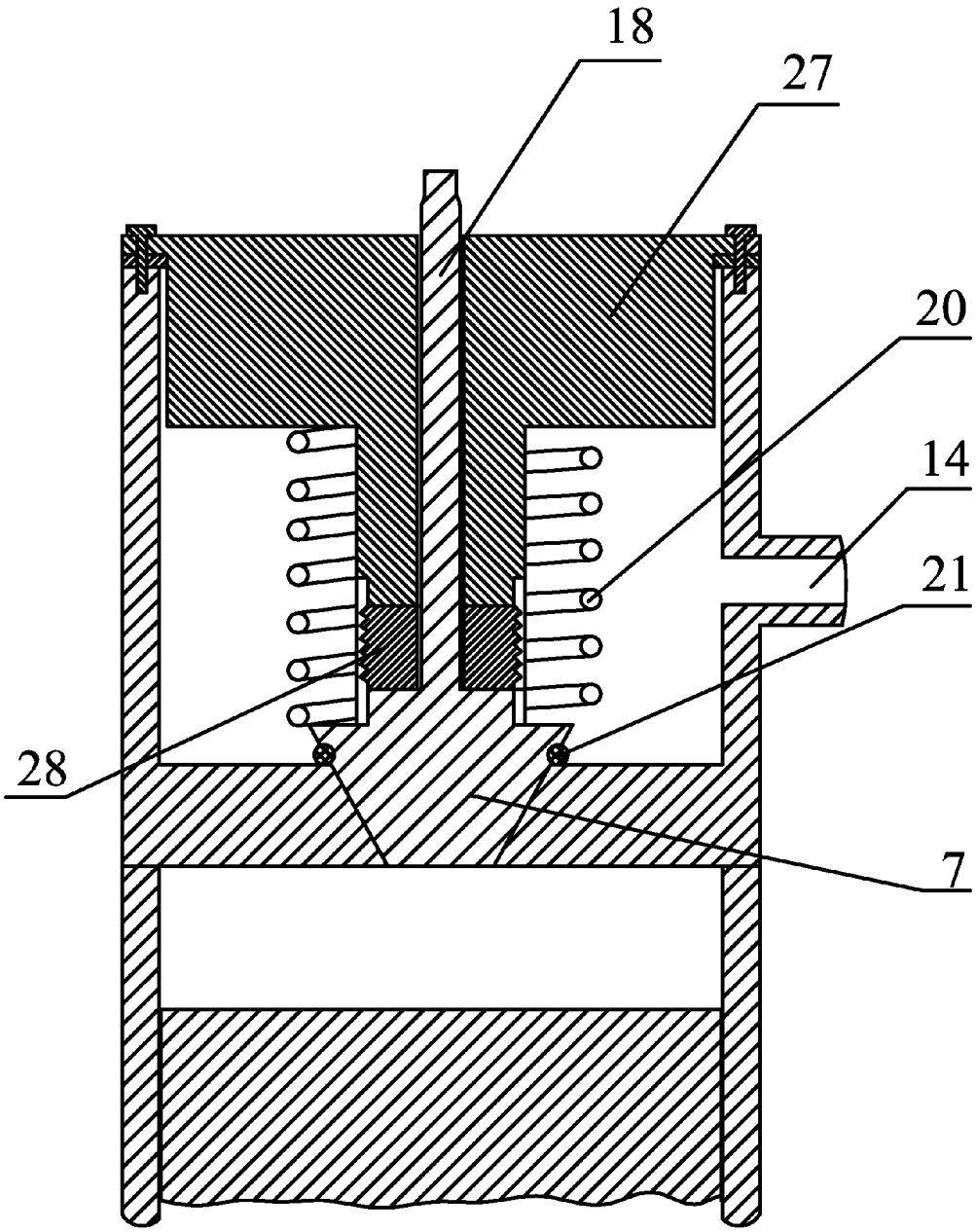
FIG. 14 is a schematic diagram of a valve-rod sealing ring according to one embodiment of the invention.
Figure 15:
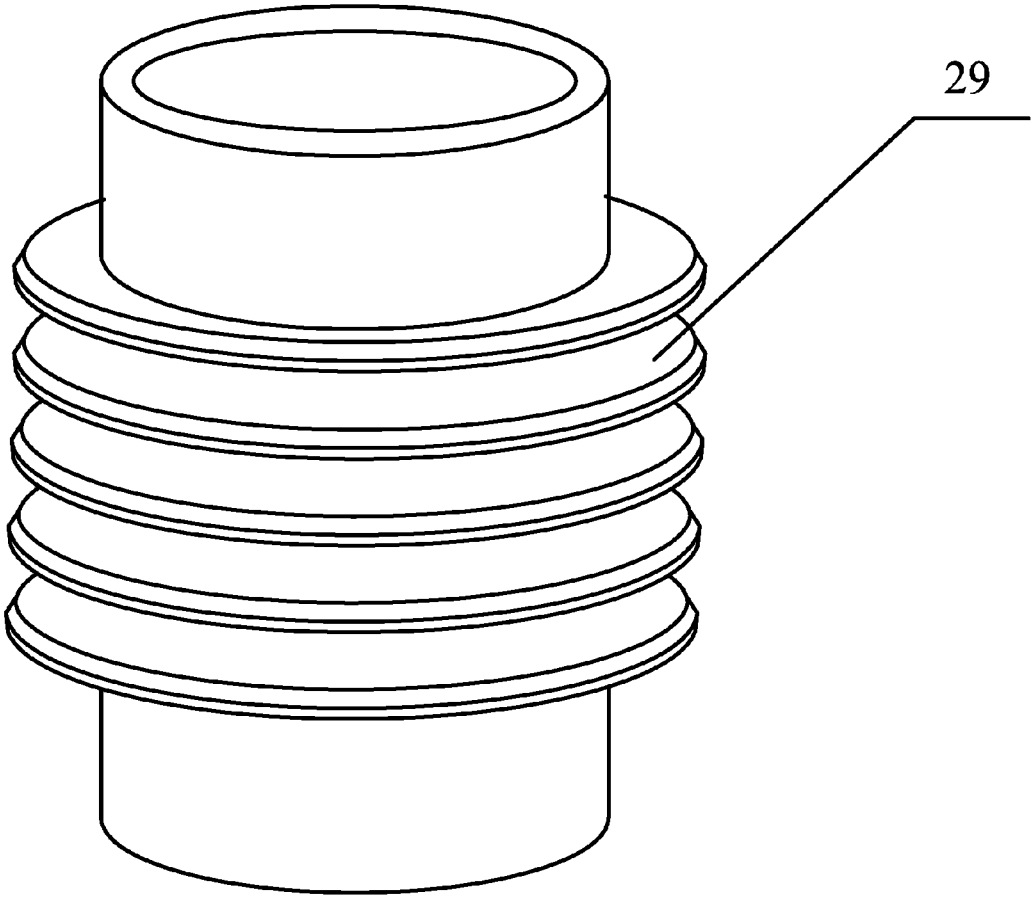
FIG. 15 is a schematic diagram of a valve-rod sealing ring according to another embodiment of the invention.
Figure 16:
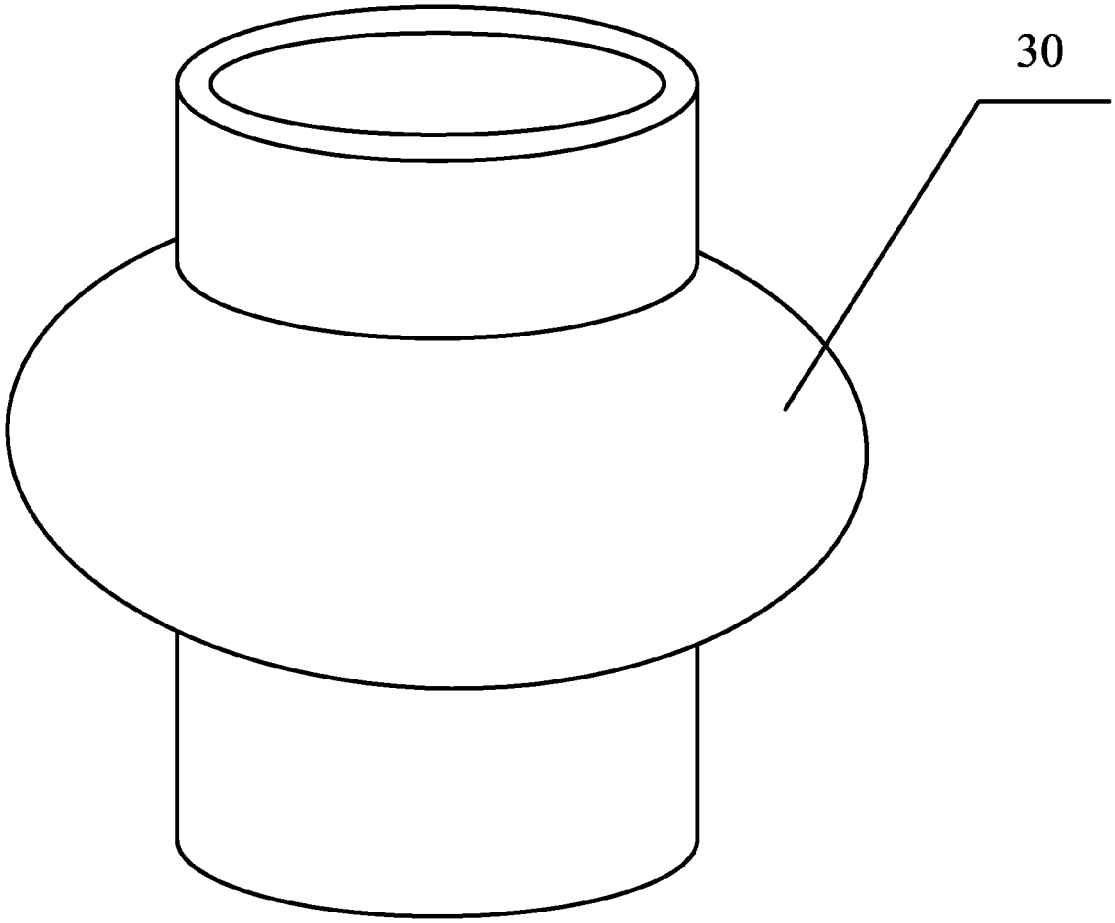
FIG. 16 is a schematic diagram of a valve-rod sealing ring according to still another embodiment of the invention.

The sealing sleeve 21 is wrapped on the intake valve, with the advantages of good sealing and gas tight. As shown in FIG. 14, the guide rod 18 is arranged in the guide-rod slide path through the valve guide pipe 27. The guide rod 18 at the lower part of the valve guide pipe 27 is externally sleeved with the valve-rod sealing ring 28. As shown in FIG. 15, a retractable folded structure 29 is arranged at the middle of the valve-rod sealing ring 28. As shown in FIG. 16, a retractable expansion structure 30 is arranged at the middle of the valve-rod sealing ring 28.

Figure 13:
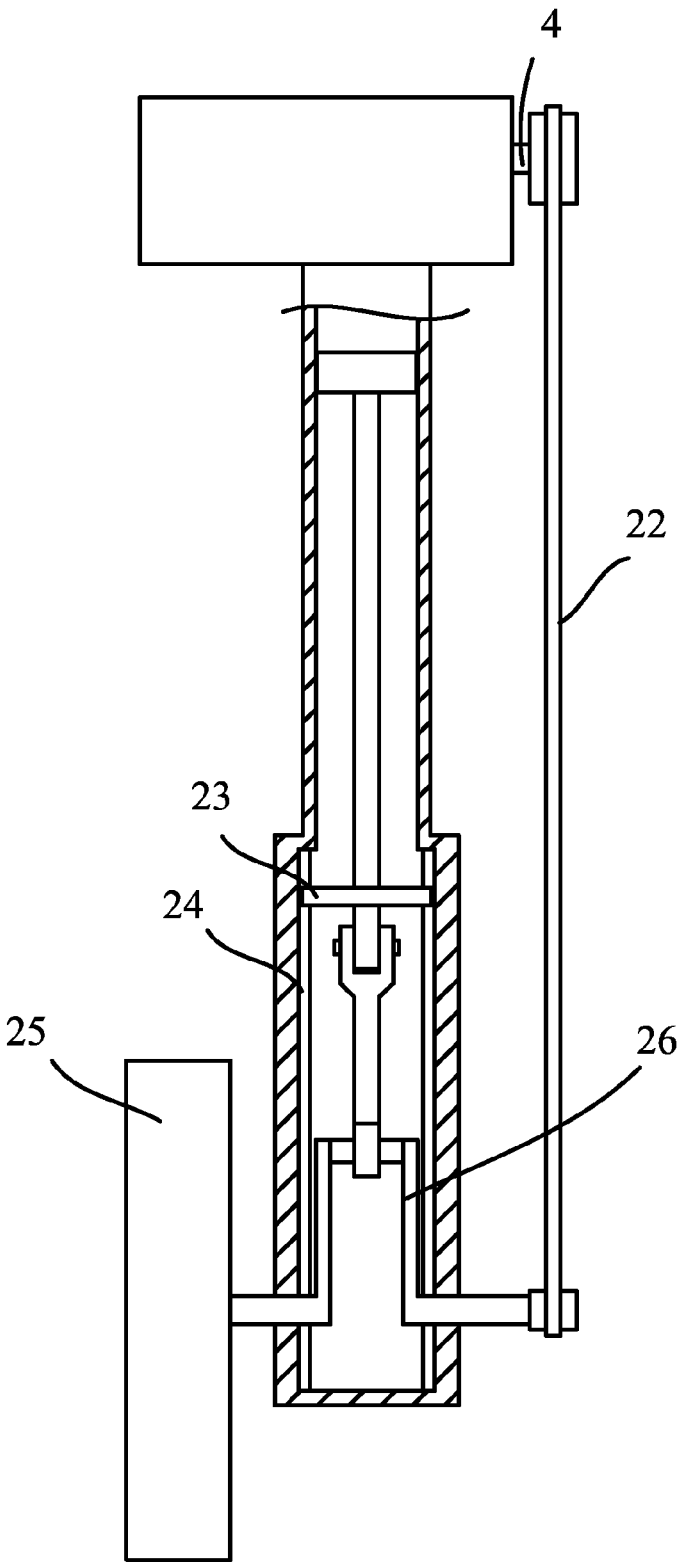
FIG. 13 is a sectional-view of a piston type pneumatic engine according to another embodiment of the invention.

FIG. 13 shows another embodiment of the invention, the differences between it and other embodiments are: as the stroke of the piston 1 is relatively long, the piston rod 10 is relatively long. Therefore, the piston rod 10 is provided with a guide device, of which the structure is: the ends of the piston rod 10 are provided with a cross pin 23, of which the two ends correspond to two lengthwise slide grooves 24 which correspond to the two ends of the cross pin 23 and are provided on the cylinder block.

With the experiments, it is found that the aims of the invention can also be realized if the bore-stroke ratio of the cylinder and the piston is 1:1.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A piston type pneumatic engine, comprising:

a) a cylinder block;

b) a piston (1);

c) a cylinder (2);

d) a crankshaft;

e) a connecting rod (3);

f) a camshaft (4); and g) a device for controlling the opening or closing of a gas valve; wherein a cylinder cover (5) is arranged on the cylinder block;

an inwardly-opened type compressed-gas intake valve (7) and an exhaust valve (6) are arranged on the cylinder cover (5);

an intake cam (8) and an exhaust cam (9) are arranged on the camshaft (4);

the opening or closing of the intake and the exhaust valves (7, 6) is controlled by a rocker arm (17) which is driven by the camshaft (4);

the camshaft is driven by the rotated crankshaft via a timing chain (22) or belt, and then high-pressure gas is controlled to enter the cylinder (2) to promote the reciprocating motion of the piston (1) and to exhaust low-pressure gas after working is completed;

the crankshaft is driven and rotated by the piston (1) via the connecting rod (3) to output power;

a suction valve (11) is also arranged on the cylinder cover (5);

a suction cam (12) is also arranged on the camshaft (4);

the opening or closing of the suction valve (11) is controlled by the rocker arm (17) so as to further control the timing for the cylinder (2) to suck air outside and be closed;

the bore-stroke ratio of the cylinder (2) and the piston (1) is 1:2-15;

a groove (13) is provided on the cylinder cover (5) corresponding to a cylinder port;

an intake port, an exhaust port, and a suction port are provided on the inner wall of the groove (13);

an intake channel, an exhaust channel, and a suction channel (14, 15, and 16) are provided at each corresponding port, respectively;

the intake channel (14) is externally connected with a compressed-gas source;

the suction and the exhaust channels (16, 15) are externally connected with atmosphere;

an intake valve, an exhaust valve, and a suction valve (7, 6, and 11) are correspondingly provided at the intake, the exhaust, and the suction ports on the inner wall of the groove (13);

the suction and the exhaust valves (11, 6) are opened toward the inner part of the groove (13); and the intake valve (7) is opened toward the inner part of the intake channel (14).

2. The piston type pneumatic engine of claim 1, wherein a structure of the intake valve (7) arranged on the inner wall of the groove (13) of the cylinder cover (5) and opened toward the inner part of the intake channel (14) is that:

a fixed and vertical guide rod (18) is arranged on the back of the gas valve corresponding to the shape of the intake port;

after passing through a guide-rod slide path (19) on the wall of the cylinder, the ends of the guide rod (18) are connected with an intake rocker arm (17) of the device controlling the opening or closing of the intake and the exhaust valves of the camshaft (4); and a compressed return spring (20) is sleeved on the guide rod (18), thereby facilitating the intake valve (7) to close the intake port from the inside of the intake channel (14).

3. The piston type pneumatic engine of claim 2, wherein a structures of the exhaust and the suction valves (6, 11) is that:

the fixed and vertical guide rod is arranged at the back of the gas valve corresponding to the shapes of the exhaust and the suction ports;

after passing through a guide-rod slide path on the wall of the cylinder, the ends of the guide rod correspond to an exhaust rocker arm and a suction rocker arm of the device controlling the opening or closing of the exhaust and the suction valves of the camshaft; and a compressed return spring (20) is sleeved on the guide rod, facilitating the exhaust and the suction valves (6, 11) to close the exhaust and the suction ports from the outside of the groove (13) of the cylinder cover (5).

4. The piston type pneumatic engine of claim 3, wherein one end of the rocker arm of the intake, the exhaust, and the suction valves (7, 6, and 11) is hinged with a fixed axle;

the middle of the rocker arm is connected with an intake valve rod, an exhaust valve rod, and a suction valve rod; and the other end of the rocker arm corresponds to the intake, the exhaust, and the suction cams of the camshaft.

5. The piston type pneumatic engine of claim 4, wherein an intake duration angle, an exhaust duration angle, and a suction duration angle of the intake, the exhaust, and the suction cams (8, 9, and 12) are 15-60degrees, 15-165 degrees and 70-90 degrees, respectively; and the start-point intervals between the intake cam (8) and the exhaust and the suction cams (9, 12) are: 15-90 degrees and 180-200 degrees, respectively.

6. The piston type pneumatic engine of claim 5, wherein the intake, the exhaust, and the suction valves (7, 6, and 11) are wrapped with a sealing rubber sleeve.

7. The piston type pneumatic engine of claim 6, wherein the ends of a piston rod (10) are provided with a cross pin (23), of which the two ends correspond to two lengthwise slide grooves (24) which correspond to the two ends of the cross pin (23) and are provided on the cylinder block.

8. The piston type pneumatic engine of claim 7, wherein the bore-stroke ratio of the cylinder (2) and the piston (1) is 1:10.

9. The piston type pneumatic engine of claim 6, wherein the guide rod (18) is arranged in the guide-rod slide path (19) through the valve guide pipe (27); and the guide rod (18) at the lower part of the valve guide pipe is externally sleeved with a valve-rod sealing ring (28).

10. The piston type pneumatic engine of claim 9, wherein the middle of the valve-rod sealing ring (28) is provided as a retractable folded structure (29) or an expansion structure (30).

11. The piston type pneumatic engine of claim 2, wherein one end of the rocker arm of the intake, the exhaust, and the suction valves (7, 6, and 11) is hinged with a fixed axle;

the middle of the rocker arm is connected with an intake valve rod, an exhaust valve rod, and a suction valve rod; and the other end of the rocker arm corresponds to the intake, the exhaust, and the suction cams of the camshaft.

12. The piston type pneumatic engine of claim 1, wherein one end of the rocker arm of the intake, the exhaust, and the suction valves (7, 6, and 11) is hinged with a fixed axle;

the middle of the rocker arm is connected with an intake valve rod, an exhaust valve rod, and a suction valve rod; and the other end of the rocker arm corresponds to the intake, the exhaust, and the suction cams of the camshaft.

* * * * *